US005119634A

United States Patent [19]

Berry et al.

[11] Patent Number: 5,119,634

[45] Date of Patent: Jun. 9, 1992

[54] MODULAR FASTENER DRIVING TOOL

[76] Inventors: Brian E. Berry, 4115 Otterbein Ave., Indianapolis, Ind. 46227; Leo V. Peterson, 14124 Inwoods Cir., Hills, Mich. 48302

[21] Appl. No.: 687,069

[22] Filed: Apr. 18, 1991

[51] Int. Cl.[5] ..... F01B 29/08

[52] U.S. Cl. ..... 60/632; 60/636

[58] Field of Search ..... 227/9, 10; 60/632, 636

[56] References Cited

U.S. PATENT DOCUMENTS 3,494,125 2/1970 Robinson ..... 60/636

4,099,581 7/1978 Maret et al. ..... 60/636 X

*Primary Examiner*—Allen M. Ostrager

[57] ABSTRACT

The powder actuated tool has a modular construction which comprises: a firing pin module; a pistol grip module; and a fastener driving module. The firing pin module and the fastener driving module are readily detachable from the pistol grip module so that if any module is damaged or needs maintenance, it may be readily removed from the rest of the tool and replaced at low cost and at no inconvenience to the user. The firing pin module includes a coherent breech assembly which is readily removable from, and securely attachable to the pistol grip module, which breech assembly comprises: a firing pin disposed in the breech assembly within a breech block; and cocking means extending from the breech assembly through the pistol grip module to engage the fastener driving module. The firing pin module has a movable sear pawl, the axis of which is disposed at an acute angle, with respect to the axis of the firing pin and breech block, so as to minimize accidental actuation of the firing pin, and also to provide a final cocking of the firing pin when the trigger is pulled.

11 Claims, 2 Drawing Sheets

MODULAR FASTENER DRIVING TOOL

TECHNICAL FIELD

This invention relates to an improved piston-type powder-actuated fastener driving tool. More particulary, this invention relates to a tool of the character described which provides an improved modular tool assembly.

BACKGROUND ART

Powder actuated tools are well known in the construction field for driving fasteners, such as nails, studs, or anchors, into a relatively hard supporting surface, such as concrete. Such tools utilize a piston for driving the fastener. The piston is typically driven by an explosive blank cartridge. Combustion gases generated from the cartridge drive the piston from a breechward position to a muzzleward position to drive the fastener into the supporting surface. Typically, tools of this type cannot be fired unless the muzzle of the tool is pushed against the surface into which the fastener is to be driven.

Due to the environment in which the tools are used, and their mode of operation, even the best made tools are subject to disabling wear and breakage. Such wear and breakage can be expensive since the entire tool must be replaced. At the very least, the user is without the use of the tool while it is being repaired.

The powder actuated tool shown in U.S. Pat. No. 4,493,376, granted Jan. 15, 1985 has a searing mechanism which uses a sear pawl which is spring-biased in a bore in the firing pin. The sear pawl is biased toward a searing position wherein the pawl engages a blocking surface on a slidable breech block in which the firing pin is slidably mounted. Both the breech block and firing pin are separately biased muzzlewardly in the tool. The sear pawl is movable in its bore along a path of travel which is disposed at a 90 degree angle relative to the direction of movement of the firing pin and breech block. When the tool is cocked, the breech block blocking surface will be urging the lower end of the sear pawl in a breechward dirction. At the same time, the firing pin spring will be urging the upper end of the sear pawl (which is disposed in the firing pin bore) in the muzzleward direction. Since the sear-releasing movement occurs in a direction perpendicular to the direction of movement of the firing pin, the aforesaid counterdirectional urging of the sear pawl actually weakens the searing ability of the sear pawl. In order to ensure that the sear will not accidentally release, the diameters of the sear pawl and the firing pin sear bore must be very closely held so that the sear pawl cannot pivot in the bore sufficiently to release the firing pin. In automatic tools which utilize a strip or disk charge magazine, the bias on the firing pin is constant, even when the tool is not cocked, thus the tendancy to pivot the sear pawl is constant. It will be appreciated that extensive use of the tools will exacerbate the aforesaid tendency to prematurely release the sear pawl. In fact, tools have accidently fired when not even cocked because of premature release of the sear pawl. Such a problem requires a solution.

DISCLOSURE OF THE INVENTION

According to the invention, a powder actuated tool is provided which has a modular design comprising: a firing pin module; a pistol grip module; and a fastener driving module. The firing pin module and the fastener driving module are readily detachable from the pistol grip module so that if any module is damaged or needs maintenance, it may be readily removed from the remainder of the tool and replaced at the job site at low cost to the user, and without significant interruption of use.

In the automatic cartridge strip feeding embodiment of the tool, the firing pin module includes an assembly adapted to be readily removable from, and securely attachable to the pistol grip module, which assembly comprises: a reciprocating breech block; a firing pin disposed within the breech block; and cocking means extending from the breech block through the pistol grip module to engage the fastener driving module. The firing pin module has a sear pawl which is disposed at an acute angle, in the breechward direction, relative to the fastener driving axis of the tool, to prevent accidental actuation of the firing pin, and which is also operative to provide a final cocking of the firing pin when the trigger is pulled.

It is therefore an object of the invention to provide a powder actuated tool which is composed of separate and individually replaceable modules.

It is a further object of the invention to provide a tool of the character described which is simple, and inexpensive to repair due to the modular construction thereof.

It is yet another object of the invention to provide a tool which is safe to use since it is finally cocked by pulling the trigger when the tool is fired.

These and other objects and advantages of the invention will become more readily apparent from the following detailed description of a preferred embodiment a tool formed in accordance with this invention when taken in conjunction with the accompanying drawings in which:

DETAILED DESCRIPTION OF THE BEST MODE

Figure 1:
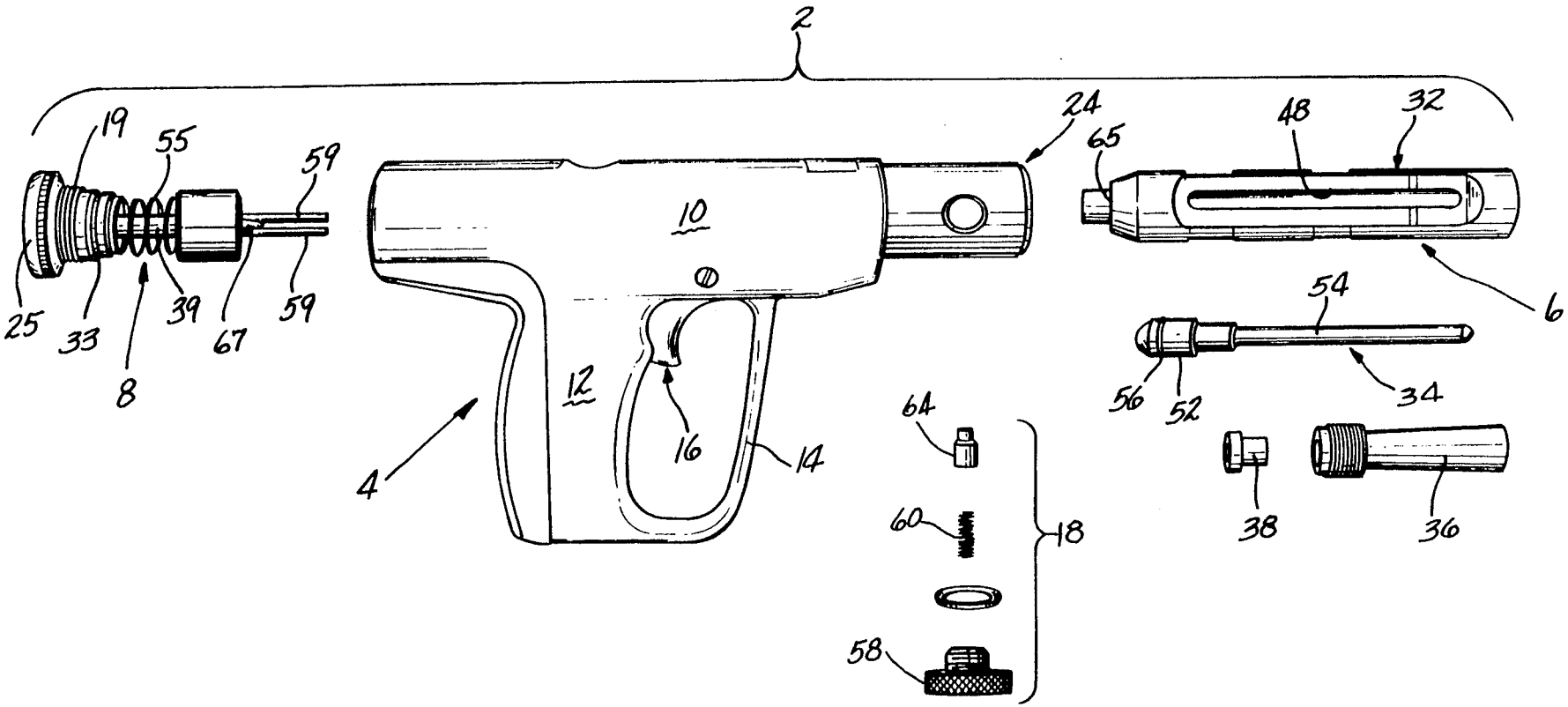
FIG. 1 is an exploded view of an automatic cartridge strip feeding embodiment of the tool of this invention.
Figures 2, 3:
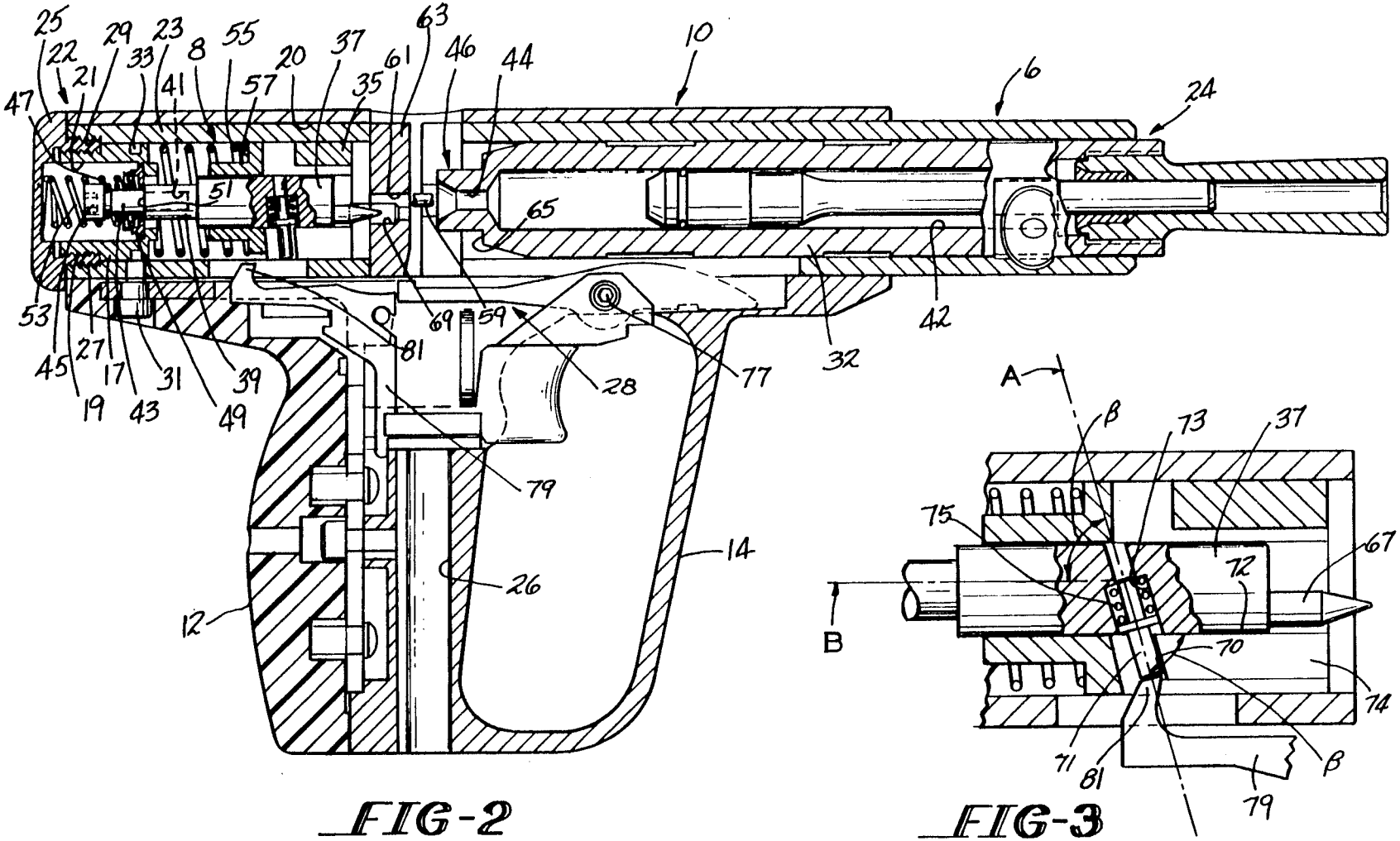
FIG. 2 is an axial sectional view of the tool of FIG. 1.
FIG. 3 is a fragmented axial sectional view of the firing pin and breech block showing how the sear pawl operates.

Referring now to FIGS. 1 and 2, a best mode embodiment of the powder actuated tool of the invention is shown. The powder actuated tool 2 comprises a pistol grip module 4, a fastener driving module 6, and a firing pin module 8. The tool 2 is designed to utilize a strip of explosive charges which are automatically fed through the tool after each fastener is driven into a supporting surface. Aside from having automatic cartridge feeding capabilities, the tool of this invention operates in a manner which is very similar to the tool shown in aforesaid U.S. Pat. No. 4,493,376, which is incorporated herein in its entirety.

THE STRIP FEEDING MODULE

The pistol grip module 4 consists of a housing 10 having a pistol grip 12, a trigger guard 14, a trigger assembly 16, and a piston return assembly 18. A bore 20 is provided in the housing 10 for receiving the firing pin module 8 at a breechward end 22 thereof and the fastener driving module 6 at a muzzleward end 24 thereof. A cartridge strip feeding channel 26 is provided in the pistol grip 12 intersecting with the bore 20. A strip feeding mechanism 28 of the type found in the prior art which operates in response to reciprocation of the tool barrel is disposed in the housing above the trigger guard 14.

THE FASTENER DRIVING MODULE

The fastener driving module 6 includes a cylindrical barrel member 32, a piston 34 disposed within the barrel 32, and a muzzle bushing 36 with an internal polyurethane buffer 38, which muzzle bushing 36 is screwed into the muzzleward end of the barrel 32. The barrel 32 is mounted slideably within the muzzleward end 24 of the housing 10.

The barrel 32 has an internal bore 42 for receiving the piston 34. A firing chamber 44 for receiving an explosive cartridge is disposed in the breechward end 46 of the barrel 32. An elongated slot 48 is disposed in the barrel 32 for reception of the piston return assembly 18 allowing the latter to contact the piston 34.

The piston 34 has a head portion 52 and a stem portion 54 extending along the bore of the barrel into the muzzle bushing 36. A piston ring 56 is disposed about the head portion 52 to provide a gas tight fit within the barrel 32.

The piston return pawl assembly 18 comprises a pawl housing 58, a spring 60 disposed within a bore in the housing 58, and a pawl 64 which is disposed in the pawl housing bore atop the spring 60. The pawl 64 extends into the barrel 32 through the barrel slot 48 to contact the piston head 52. The piston return assembly 18 operates in the same manner as in the tool disclosed in U.S. Pat. No. 3,066,302 to DeCaro et al, which is incorporated herein in its entirety.

THE FIRING PIN MODULE

The firing pin module 8 can be removed from the breechward end of the housing 10 in one piece and replaced with a duplicate module if breakage or malfunction occurs.

Referring to FIGS. 1, 2 and 3, the module 8 includes a bushing 17 which has an externally threaded end 19 and a through bore 21. The bushing 17 fits into a sleeve 23 disposed in the breechward end 22 of the housing 10. An end cap 25 is threaded onto the end 19 of the bushing 17. The end cap 25 has an external thread 27 which matches an internal threaded counterbore 29 in the sleeve 23. When the end cap 25 is screwed into the sleeve 23, a set screw 31 is operable to fix the bushing 17 in place via a groove 33 in the bushing 17. A breech block 35 contains the firing pin 37 which has a tail portion 39 with a threaded bore 41 receiving a connecting screw 43. The connecting screw 43 has an enlarged head 45 which compresses a spring 47 against a pressure plate 49 thereby pressing the plate 49 against a shoulder 51 on the firing pin 37. A firing pin spring 53 biases the firing pin 37 muzzleward and away from the end cap 25 via the pressure plate 49.

The breech block 35 is biased muzzleward by a spring 55 which engages the bushing 17 on one end, and a breech block shoulder 57 on the other end. The breech block 35 and firing pin 37 are thus separately biased in the muzzleward direction in the tool. A pair of cocking rods 59 are mounted on the breech block 35 and extend muzzlewardly therefrom through a pair of passages 61 extending through a breech plate 63 in the tool. The rods 59 contact a shoulder 65 on the barrel 32 when the latter is pushed breechwardly to cock the tool.

The firing pin assembly 37 includes a striker 67 which moves through passage 69 to strike the rim of a chambered cartridge when the tool is fired. A sear pawl 71 is biased in a transverse passage 73 in the firing pin assembly 37 by a sear spring 75. The trigger assembly 16 pivots about a pin 77 and includes a disconnector 79 which has a tang 81 offset from the sear pawl 71 until the tool is cocked. Operation of the sear pawl 71 and the trigger assembly 16, insofar as cocking and firing the tool is substantially the same as described in above-noted U.S. Pat. No. 4,493,376.

The searing and triggering operations of the tool of the invention is improved over the prior art. Referring to FIG. 3, it will be noted that the axis A of the sear pawl 71 and the bore 73 in which it is mounted are disposed at an acute angle $\beta$ to the axis B of the firing pin 37. Likewise, a sear pawl-engaging shoulder 70 on the breech block 35 is skew at the angle $\beta$ relative to the axis B of the firing pin 37. The shoulder 70 and the top surface 72 of the breech block slot 74 meet at the acute angle $\beta$ thus providing a more secure engagement of the sear pawl 71 against the shoulder 70 than is possible with the right angle pawl/shoulder combination of the prior art. The result is a safer tool which is less likely to accidentally discharge than the tools of the prior art. The acute angle $\phi$ is preferably about 88 degrees.

Another result of disposing the firing pin sear pawl 71 at an acute angle relative to the axis B of the firing pin 37 is that movement of the trigger assembly tang 81 against the pawl 71 to fire the tool results in breechward movement of the firing pin 37, which further compresses the firing pin spring 53 before the sear pawl 71 disengages from the shoulder 72. Thus actuation of the trigger completes cocking of the firing pin 37, a feature not found in the prior art tools of this type.

Because of the tool's modular design, a user can maintain the tool without being deprived of the use of the tool by replacing modules as is necessary. Due to the skew disposition of the firing pin pawl relative to the firing pin axis, the tool is safer to use.

Since many changes and variations of the disclosed embodiment of the invention may be made without departing from the inventive concept, it is not intended to limit the invention other wise than is required by the appended claims.

What is claimed is:

1. A firing pin module for use in a powder actuated fastener driving tool of the type having a pistol grip housing, said module being removable from a breechward end of said housing, and said module comprising:
   a) a firing pin;
   b) a breech block in which said firing pin is slidably mounted;
   c) a cap operable to close said breechward end of said housing;
   d) a firing pin spring sandwiched between said cap and said firing pin to bias the latter in a muzzleward direction relative to the breech block in the tool;
   e) a breech block spring sandwiched between said cap and said breech block to bias the latter in a muzzleward direction relative to the pistol grip housing in the tool; and
   f) means connecting said cap, said firing pin and said breech block together whereby said module can be removed as a coherent unit from the remainder of the tool.

2. The firing pin module of claim 1 wherein said cap is threaded onto said breechward end of said housing.

3. The firing pin module of claim 2 further comprising a bushing threaded into said cap and providing a breechward stop for said breech block spring.

4. The firing pin module of claim 1 further comprising a firing pin sear pawl mounted on said firing pin and connecting said firing pin to said breech block when said module is removed from said housing.

5. The firing module of claim 4 wherein said sear pawl has an axis of elongation which is disposed at a muzzleward acute angle relative to an axis of elongation of said firing pin.

6. The firing pin module of claim 1 wherein said means connecting comprises a screw threaded into a breechward end of said firing pin.

7. The firing pin module of claim 6 further comprising a pressure plate mounted on said screw and biased against said firing pin by a pressure plate spring sandwiched between said screw and said pressure plate.

8. The firing pin module of claim 7 wherein said firing pin spring is sandwiched between said cap and said pressure plate.

9. The firing pin module of claim 7 further comprising a bushing threaded onto said cap and forming a muzzleward stop for said pressure plate after the tool has been fired.

10. A powder actuated fastener driving tool comprising a pistol grip housing, a cartridge driving module releasably fitted into a muzzleward end of said housing, and a firing pin module releasably fitted into a breechward end of said housing, said firing pin module comprising: a firing pin; a breech block in which said firing pin is slidably mounted; a cap operable to close said breechward end of said housing; a firing pin spring sandwiched between said cap and said firing pin to bias the latter in a muzzleward direction in the tool; a breech block spring sandwiched between said cap and said breech block to bias the latter in a muzzleward direction in the tool; and means interconnecting said cap, said firing pin, and said breech block together, whereby said firing pin module can be removed as a coherent unit from said pistol grip housing.

11. A powder actuated fastener driving tool comprising a pistol grip housing having a breechward end and a muzzleward end; a firing pin assembly mounted in said breechward end of said housing, said firing pin assembly including a breech block mounted in said housing for reciprocal movement therein along a first rectilinear path of travel; a breech block spring for biasing said breech block in the muzzleward direction; a firing pin mounted in said breech block for reciprocal movement therein along said first rectilinear path of travel; a firing pin spring for biasing said firing pin in the muzzleward direction; a sear pawl mounted in said firing pin and movable therein along a second rectilinear path of travel which intersects said first path of travel at a muzzleward acute angle; a latching shoulder on said breech block for engagement with said sear pawl when said firing pin and said breech block are in an extreme muzzleward position in the housing; a sear spring for biasing said sear pawl in a latching shoulder-engaging direction; and a trigger assembly for actuation to disengage said sear pawl from said latching shoulder, said firing pin being moved breechwardly initially in response to said pawl being disengaged from said latching shoulder by said trigger assembly by reason of the acute angular relationship between said first and second paths of travel.

* * * * *